US008505459B2

(12) United States Patent
Miller et al.

(10) Patent No.: US 8,505,459 B2
(45) Date of Patent: Aug. 13, 2013

(54) VERTICAL FORCE STABILIZER

(75) Inventors: Robert S. Miller, Columbia, SC (US); Anthony P. Delucia, Gaston, SC (US)

(73) Assignee: Harsco Corporation, Camp Hill, PA (US)

( * ) Notice: Subject to any disclaimer, the term of this patent is extended or adjusted under 35 U.S.C. 154(b) by 151 days.

(21) Appl. No.: 12/986,286

(22) Filed: Jan. 7, 2011

(65) Prior Publication Data

US 2012/0174816 A1 Jul. 12, 2012

(51) Int. Cl.
*E01B 27/00* (2006.01)

(52) U.S. Cl.
USPC ..... 104/12; 104/7.1; 104/7.2

(58) Field of Classification Search
USPC ..... 104/2, 7.1, 7.2, 7.3, 10, 14
See application file for complete search history.

(56) References Cited

U.S. PATENT DOCUMENTS

| | | | | |
|---|---|---|---|---|
| 3,179,062 | A * | 4/1965 | Christoff | 104/7.3 |
| 3,427,990 | A * | 2/1969 | Bryan, Jr | 104/2 |
| 3,919,943 | A * | 11/1975 | Plasser et al. | 104/7.1 |
| 3,926,123 | A * | 12/1975 | Plasser et al. | 104/7.1 |
| 4,046,078 | A | 9/1977 | Theurer | |
| 4,046,079 | A | 9/1977 | Theurer | |
| 4,064,807 | A | 12/1977 | Theurer | |
| 4,125,075 | A * | 11/1978 | Stewart | 104/7.2 |
| 4,430,946 | A | 2/1984 | Theurer et al. | |
| 4,492,891 | A | 1/1985 | Wieters | |
| 4,528,912 | A | 7/1985 | Hansmann et al. | |
| 4,890,557 | A * | 1/1990 | Whitaker, Jr. | 104/7.3 |
| 5,172,637 | A | 12/1992 | Theurer et al. | |
| 5,419,259 | A | 5/1995 | Theurer et al. | |
| 5,617,794 | A * | 4/1997 | Theurer et al. | 104/7.2 |
| 2012/0174816 | A1 * | 7/2012 | Miller et al. | 104/12 |

FOREIGN PATENT DOCUMENTS

| | | | |
|---|---|---|---|
| CH | 578654 | A5 | 8/1976 |
| DE | 1658354 | B1 | 11/1970 |
| FR | 1174955 | A | 3/1959 |

OTHER PUBLICATIONS

MTH Praha a.s.—Ballast compactors and stabilizers, http://www.mth.cz/vyroba/skupina_03_en.html, 2 pgs., accessed Nov. 29, 2010.

HARSCO TS-50 Track Stabilizer, Harsco Rail—Hy-Rail®, http://www.harscorail.com/products/track-stabilizer-TS-50. aspx, 2 pgs., accessed Nov. 24, 2010.

HARASO TS-30 Track Stabilizer, Harsco Rail—Hy-Rail®, http://www.harscorail.com/products/track-stabilizer-TS-30. aspx, 2 pgs., accessed Nov. 24, 2010.

* cited by examiner

*Primary Examiner* — Jason C Smith
(74) *Attorney, Agent, or Firm* — Baker & McKenzie LLP

(57) ABSTRACT

An exemplary apparatus and method for applying a force to rails of a track is disclosed. The apparatus has a device with at least one first weight and at least one second weight rotatably mounted about a horizontal shaft which has an axis which is essentially perpendicular to the longitudinal axis of the rails. A power source is provided to drive the rotation of the at least one first weight and the at least one second weight at different revolutions per second. The rotation of the at least one first weight and the at least one second weight creates a vertical force which has a larger downward component as compared to an upward component of the vertical force.

24 Claims, 7 Drawing Sheets

VERTICAL FORCE STABILIZER

FIELD OF THE INVENTION

The present invention is directed to an apparatus and method for applying a force to rails of a track. In particular, the invention is directed to the rotation of weights creates a vertical force which has a larger downward component as compared to an upward component of the vertical force.

BACKGROUND OF THE INVENTION

Machines of the type used for compacting ballast of a ballast bed of a railroad track are known in the art. Generally, these machines comprise a machine frame, undercarriages supporting the machine frame on the track rails for movement in an operating direction, and a track stabilization unit mounted on the machine frame. The track stabilization often includes a chassis, guide roller means firmly holding the chassis in engagement with the track rails and guiding the chassis along the track upon movement of the machine frame in the operating direction, vibrator means for imparting essentially horizontal vibrations to the track, and power drive means connecting the chassis to the machine frame and arranged to impart essentially vertical load forces to the chassis. The machine may have control means for operating the track stabilization units and other workheads which may be provided on the machine.

A machine of this general type has been disclosed, for example, in U.S. Pat. No. 3,926,123. This machine has a frame supported on two undercarriages and having a frame portion overhanging the front undercarriage. The tamping unit is mounted on the overhanging frame portion and the track stabilization unit is mounted on the machine frame between the two undercarriages. With this machine, the track is brought to the desired level, is fixed at this level by tamping the ballast under the track-supporting ties, and the position of the leveled track is then stabilized. Another such machine is disclosed in U.S. Pat. No. 4,046,078. This machine has a mobile machine frame supporting a track stabilization unit between two undercarriages. During the dynamic track stabilization effected with these prior art machines, the previously tamped ballast is so fluidized as to become denser, thus reducing the volume of the ballast bed and causing the track to sink to a lower level. This anticipates the kind of ballast settling occurring normally under train traffic subsequent to track tamping operations and enhances the resistance of the tamped ties to transverse movement relative to the ballast bed. Since the track stabilization unit chassis is downwardly pressed while being vibrated horizontally in a direction transverse to the track, it causes the firmly gripped track to be embedded in the fluidized ballast against lateral movement of the ties while the ballast is further densified. In this manner, the tamped ballast is further compacted under the ties and at their sides, which reduces the ballast volume and lowers the level of the track supported thereon.

In order to provide maximum horizontal vibration force to the track stabilizer, various apparatuses and methods have been introduced to maximize the horizontal vibration, while minimizing or neutralizing the vertical forces. One such apparatus is the Plasser Dynamic Track Stabilizer (DTS). The Plasser DTS has two (2) vibrating workheads connected in series by drive shafts to synchronize the vibration. In each unit there are two (2) equal rotating weights, one above the other, geared to rotate in opposite directions. In this configuration, the weights and shafts are designed such that when one weight is moving upward, the other is moving downward.

This neutralizes the vertical force associated with the rotating weights. When the weights are towards the left or right, they become additive and create a left to right oscillating force. The magnitude of this force varies with the speed of rotation of the weights, reaching a maximum of 19.5 tons at 33 Hz. Weight is transferred vertically from the machine to the vibrating workheads by hydraulic cylinders, thereby allowing the control system of the machine to increase or decrease the settlement of each rail. This can be up to 50,000 pounds per side.

Another apparatus is the Harsco Rail/MTH DTS. This apparatus or unit utilizes a similar concept of rotating weights to create the left to right vibration which is imparted into the rails. The weights are located on a single carriage with the shafts being vertical. When the weights are moving apart or together in the longitudinal direction of the rails, the forces cancel. When they are moving towards the rails, either left or right, the force is additive. The maximum lateral force is 50 tons at 45 Hz. Weight is transferred vertically from the machine to the vibrating workhead by hydraulic cylinders in a similar fashion to the Plasser unit.

While these machines and apparatuses have proven effective, in order to provide the required reaction for the vertical or downward force applied to the workhead, it is necessary to add a significant amount of weight to the machine. This results in machines which require a significant amount of steel to provide the required weight. As a result, it becomes necessary to have larger axles, a more powerful drive train, and greater braking efforts. All of these things increase the cost of the machine.

It would, therefore, be advantageous to have a machine in which the vertical reaction capability could be provided without the need for the increased weight of the machine, thereby reducing the size and cost of the machine while still providing the necessary vibration and downward force required to properly stabilize the ballast and the track.

SUMMARY OF THE INVENTION

An exemplary apparatus for applying a force to rails of a track is disclosed. The apparatus has a device with at least one first weight and at least one second weight rotatably mounted about a horizontal shaft which has an axis which is essentially perpendicular to the longitudinal axis of the rails. A power source is provided to drive the rotation of the at least one first weight and the at least one second weight at different revolutions per second. The rotation of the at least one first weight and the at least one second weight creates a vertical force which has a larger downward component as compared to an upward component of the vertical force.

An exemplary vehicle for compacting ballast under rails of a track is disclosed. The vehicle includes a traction stabilization unit with a first vibrator unit which generates forces which are transverse to a longitudinal axis of the rail. At least one vertical force device with at least one first weight and at least one second weight is rotatably mounted about a horizontal shaft which has an axis which is essentially perpendicular to the longitudinal axis of the rails. A control mechanism is provided to control transverse forces applied to the rails and to control vertical forces applied by the at least one vertical force device. The transverse forces generated by the traction stabilization unit and the vertical forces generated by the at least one vertical force device cause the ballast proximate the rails to be moved together to reach a high density.

An exemplary method of supplying downward force to rails of a track is disclosed. The method includes: positioning a device on a rail vehicle, the device having at least one first weight and at least one second weight rotatably mounted on the device; positioning the rail vehicle over a work area; and creating a vertical force by rotating the at least one first weight and the at least one second weight at different revolutions per second.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
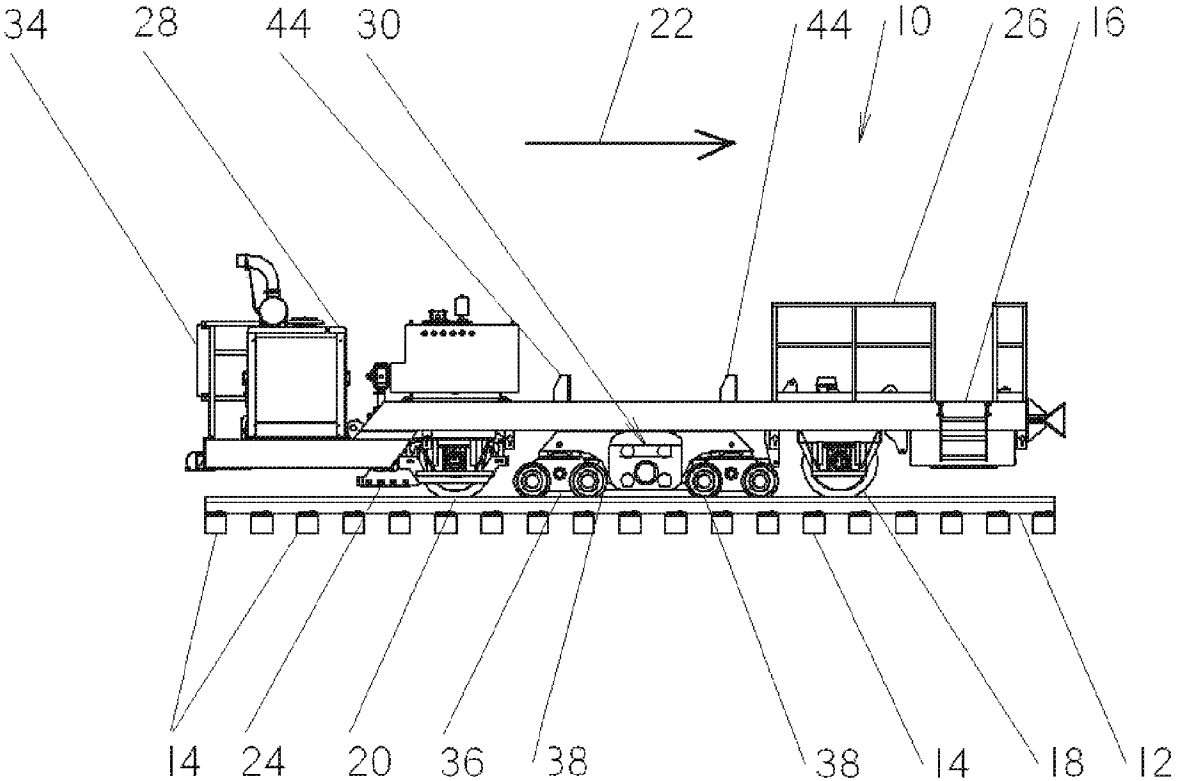
FIG. 1 is a side elevation view of an exemplary embodiment of a railroad maintenance vehicle with a vertical force stabilizer unit.

Referring now to the drawing and first to FIG. 1, there is shown a railroad maintenance machine or vehicle 10 for compacting ballast of a ballast bed supporting a track consisting of two rails 12 fastened to ties 14 resting on the ballast. The vehicle 10 has a frame 16 and undercarriages 18, 20, supporting the frame 16 on the rails 12 for movement in an operating direction indicated by arrow 22. A drive 24 powers rear undercarriage 20 to move the vehicle 10 in the operating direction. An operator's cab or platform 26 is mounted on the front end of frame 16, which also carries a power plant 28 for the vehicle 10. Between the power plant 28 and the front undercarriage 18, which is shown as a single-axle swivel truck, frame 16 carries at least one track stabilization unit 30. A plurality of other additional workheads or units may be provided on the frame 16 proximate the track stabilization unit 30. Such additional units may include, but are not limited to, ballast tamping units and track correction units. Another operator's cab or platform (not shown) may be provided at the rear end of frame 16 for operating and monitoring the work of stabilization unit 30 and other additional units. A control means 34 for operating the units may be controlled from the operator's platform 26. The configuration of the vehicle 10 is shown for exemplary purposes only. The track stabilization unit 30 may be used with vehicles of varying configurations.

According to the present invention, the track stabilization unit 30 is mounted on frame 16. The track stabilization unit 30 includes a chassis 36 with rollers 38 firmly holding the chassis 36 in engagement with the rails 12 and guiding the chassis 36 along the rails 12 upon movement of the frame 16 in the operating direction. A first vibrator device 42 is arranged to impart essentially horizontal vibrations to the rails 12. A power drive 44, illustrated as hydraulic jack, connects the chassis 36 to the frame 16 and is arranged to impart essentially vertical load forces to the chassis 36. A pair of vertical force stabilizer apparatuses or units 46 is provided on the chassis 36 over each rail 12. Each vertical force stabilizer unit 46 has a second vibrator device 48 housed in a vibrator box 50. While the embodiment shown has two vertical force stabilizer units 46, other configurations are possible. For instance, one vertical force stabilizer unit may be provided on the chassis and centered between the rails 12.

The illustrated rollers 38 of the track stabilization unit 30 comprise four sets of flanged guide rollers 38 supporting the chassis 36 for movement on the rails 12, with two sets of guide rollers 38 positioned over each rail 12. The guide rollers 38 are pivotally mounted on axles of the chassis 36. The pivotal mounting of the guide rollers 38 allows the rollers 38 to be properly seated on and follow the rails 12, even through curves or irregularities of the rails 12. The flanged guide rollers 38 of each set are firmly pressed against the insides of the heads of both rails 12 by spreading drives 52 which hold the flanged guide rollers 38 in this engaging position during track stabilization. In this manner, track stabilization unit 30 is firmly held in tight engagement with the rails 12 so that the rails 12 will move substantially integrally with the track stabilization unit 30. The spreading drives 52 can be in the form of hydraulic cylinders which can expand or contract to accommodate or conform the guide rollers 38 to variations in track gauge and the like.

The first vibrator device 42 is arranged on the chassis 36 of the track stabilization unit 30 for imparting essentially horizontal vibrations to the rails 12 in a direction extending transversely to the rails 12. Examples of such first vibrator devices 42 are taught in U.S. Pat. No. 4,430,946, which is hereby incorporated, in its entirety, herein, and found in Harsco TS-50 Track Stabilizer Vehicle. The first vibrator device may include rotating weights to create the left-to-right vibration which is imparted into the rails. The weights may be located on a single carriage with the shafts being vertical and essentially perpendicular to the longitudinal axis of the rail. When the weights are moving apart or together in the longitudinal direction of the rails 12, the forces cancel. When the weights are moving towards the rails 12, the lateral force is additive. These lateral force vibrations are transmitted to the track by guide roller means 38. The lateral force generated is dependent upon the speed at which the weights are rotated, which is controlled by the control means 34. Such first vibrator devices generally can generate a maximum lateral force of approximately 50 tons at 45 Hz.

Figure 2:
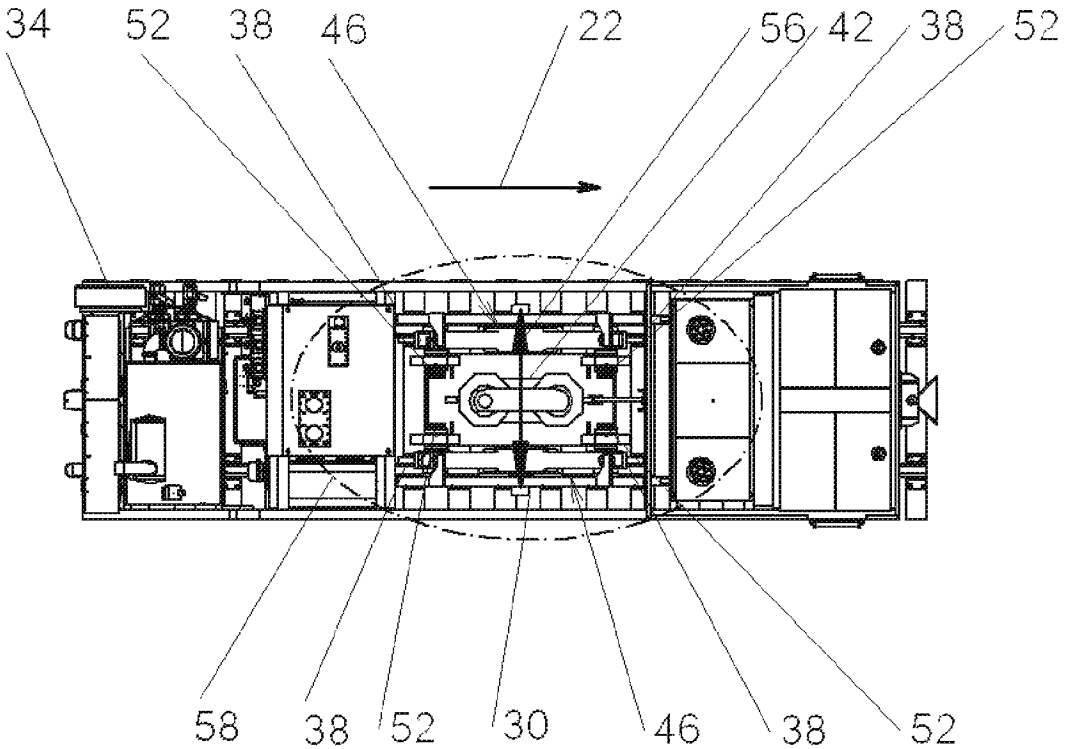
FIG. 2 is a diagrammatic view of a top view of a track and various components of the vehicle of FIG. 1, including the track stabilization unit.

As shown in FIG. 2, the vibratory motions of the track stabilization unit 30 during dynamic track stabilization are indicated by double-headed arrows 56 and cause rails 12 proximate the track stabilization unit 30 to be alternately elastically deformed to the left and to the right, or transverse to the longitudinal axis of the rails 12, and these vibrations are transmitted by ties 14 to the ballast, causing the same to be fluidized, while the downward pressure causes the fluidized ballast to move closely together to reach a very high density. The dynamic stabilization zone thus created is indicated by circle 58.

As previously stated, downward pressure may be applied to the track stabilization unit 30 by using the power drive 44 and the weight of the vehicle 10. However, using only these means, it is necessary to add a significant amount of weight to the machine in order to provide the required reaction for the downward force applied to the guide rollers 38 of the track stabilization unit 30. This could result in a vehicle with a weight of between 100,000 and 120,000 pounds. In contrast, the use of the vertical force stabilizer unit 46 on the track stabilization unit 30 provides the required downward force, but does not increase the weight of the vehicle, thereby allowing the vehicle to be substantially lighter, i.e., in the range of 50,000 pounds.

Figure 3:
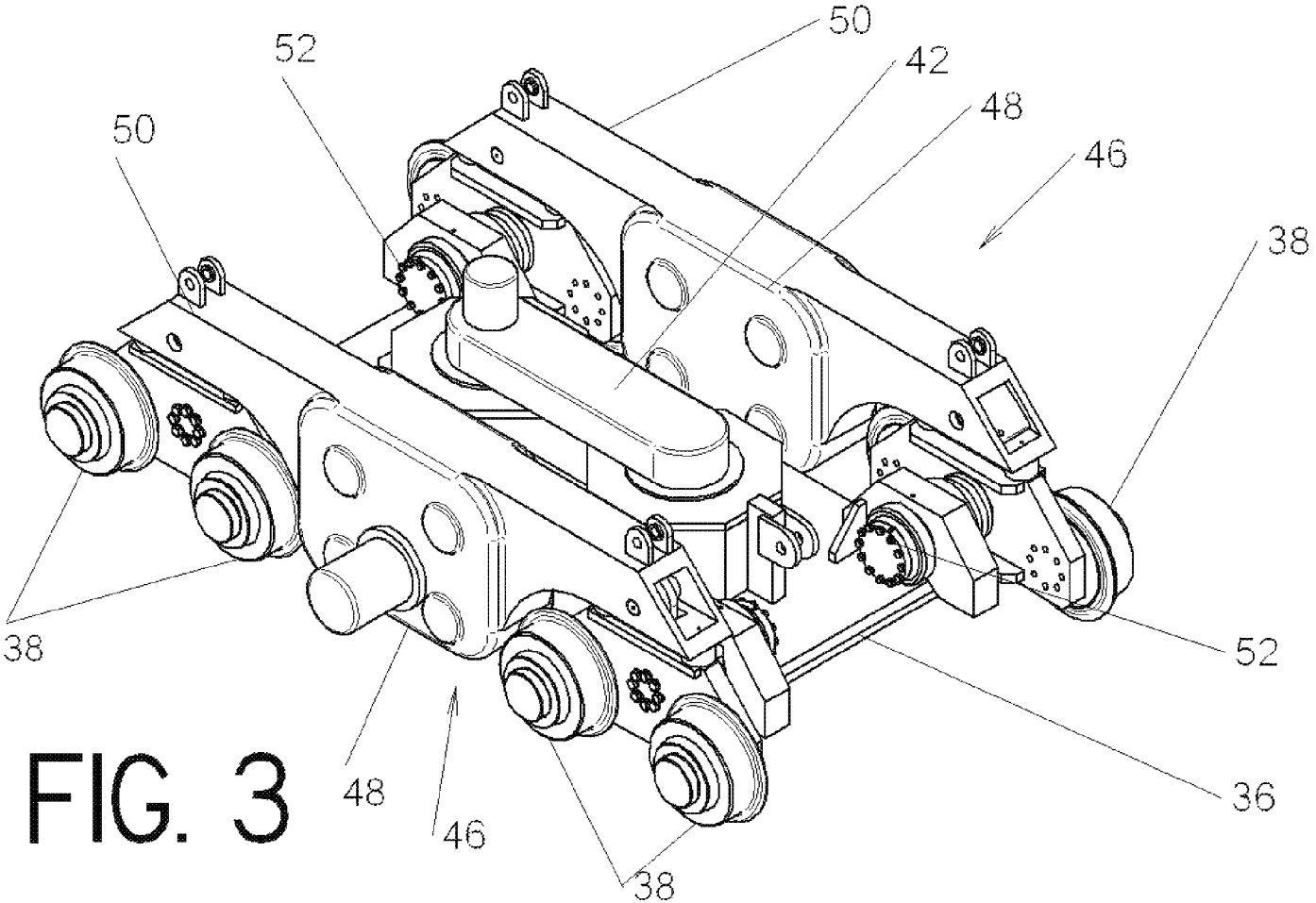
FIG. 3 is a perspective view of a chassis of the track stabilization unit with a pair of vertical force stabilization units positioned thereon.
Figure 4:
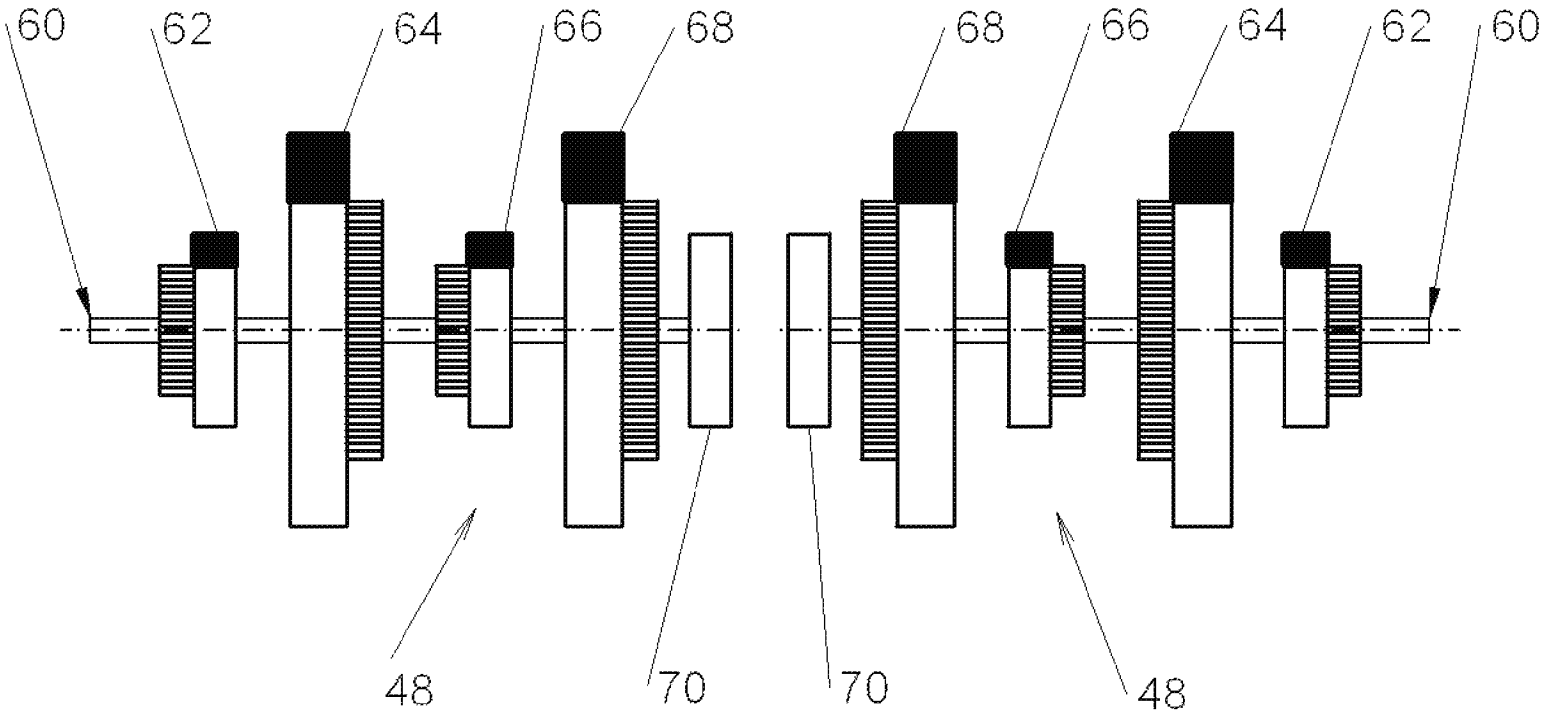
FIG. 4 is a cross-sectional view taken along line 4-4 of FIG. 3.
Figure 5:
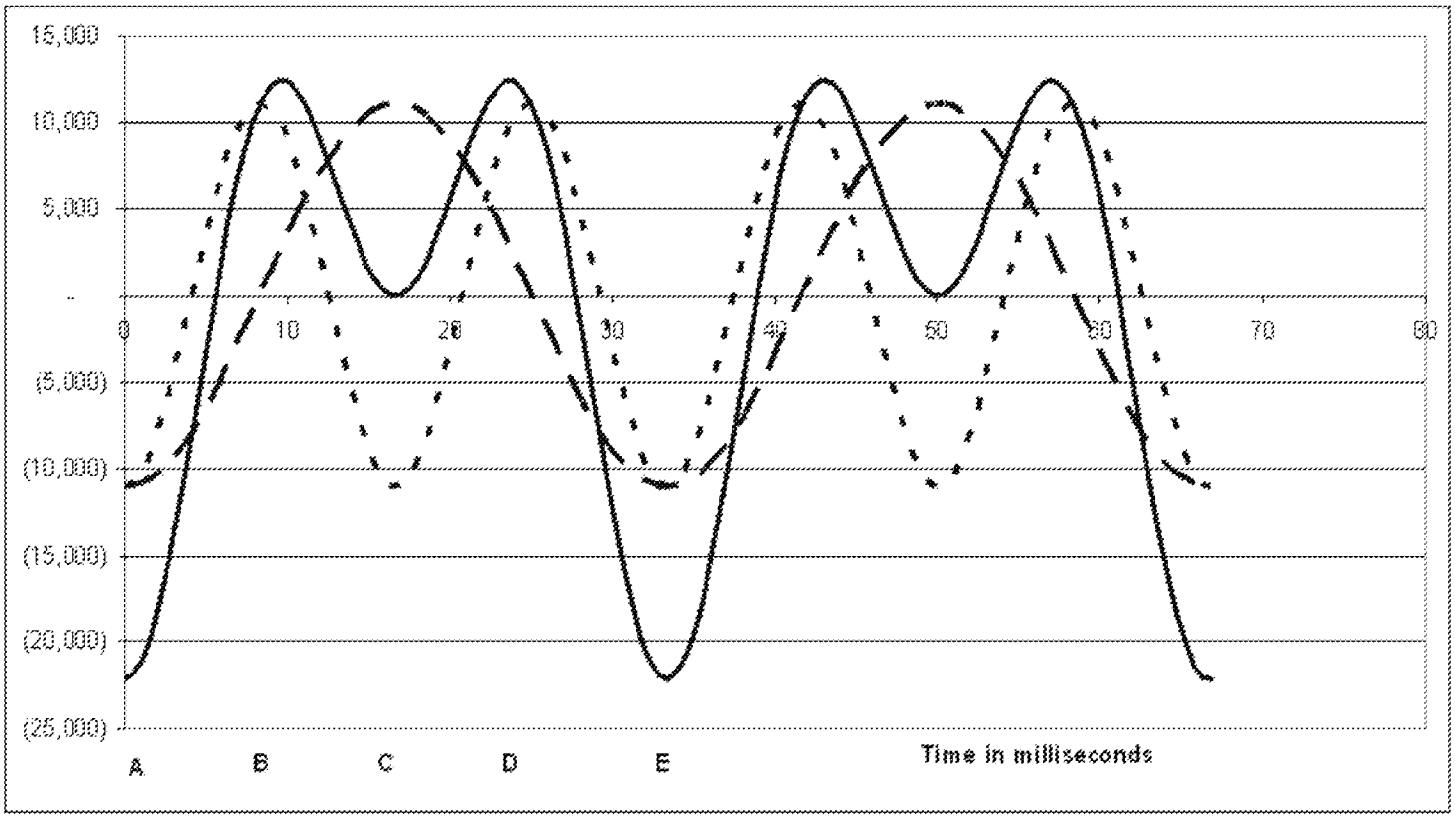
FIG. 5 is an exemplary graph of the vertical forces generated by an exemplary vertical force stabilization unit having two small weights and two large weights, as weights of the vertical force stabilization unit are rotated.

As shown in FIGS. 3 and 4, each vertical force stabilizer unit 46 has the vibrator device 48 housed in a box 50. The vibrator device 48 comprises a horizontal shaft 60 about which at least one small weight 62 and at least one large weight 64 are mounted by means of gears or the like. In the exemplary embodiment, the large weight 64 is twice as heavy as the smaller weight 62. The rotating weights create a downward force which is imparted into the rails. The smaller weight 62 is rotated at twice the speed of the larger weight 64, resulting in a summation of the forces in the downward direction and a cancelling of ½ of the force in the upward direction, as is shown in the graph of FIG. 5. In so doing, the upward forces will be reduced, thereby preventing the guide rollers 38 from being lifted off of the respective rail 12 and impacted down against the rail 12 as the downward forces are realized. The force generated is dependent upon the diameter of the weight, the eccentricity of the weight, and the speed at which the weights are rotated. The speed at which the weights are rotated is controlled by the control means 34. While a 1:2 weight ratio and a 2:1 speed ratio are described for the small weight 62 compared to the large weight 64, other ratios may be used to optimize the performance of the vertical force stabilizer unit 46 as required.

As shown in FIGS. 4 through 7, the exemplary embodiment of the vertical force stabilizer unit 46 also has a second pair of rotating weights which are gear-connected to the first pair. The second pair of rotating weights also has a small weight 66 and a large weight, which are mounted on the horizontal shaft 60. Similar to the weights of the first pair, the large weight 68 is twice as heavy as the smaller weight 66. The rotating weights create a downward force which is imparted into the rails. The smaller weight 66 is rotated at twice the speed of the larger weight 68, resulting in a summation of the forces in the downward direction and a cancelling of ½ of the force in the upward direction, as is shown in FIG. 5. In so doing, the upward forces will be reduced, thereby preventing the guide rollers 38 from being lifted off of the respective rail 12 and impacted down against the rail 12 as the downward forces are realized. The force generated is dependent upon the diameter of the weight, the weight of the weight, and the speed at which the weights are rotated. The speed at which the weights are rotated is controlled by the control means 34. While a 1:2 weight ratio and a 2:1 speed ratio are described for the small weight 66 compared to the large weight 66, other ratios may be used to optimize the performance of the vertical force stabilizer unit 46 as required.

Figure 7:
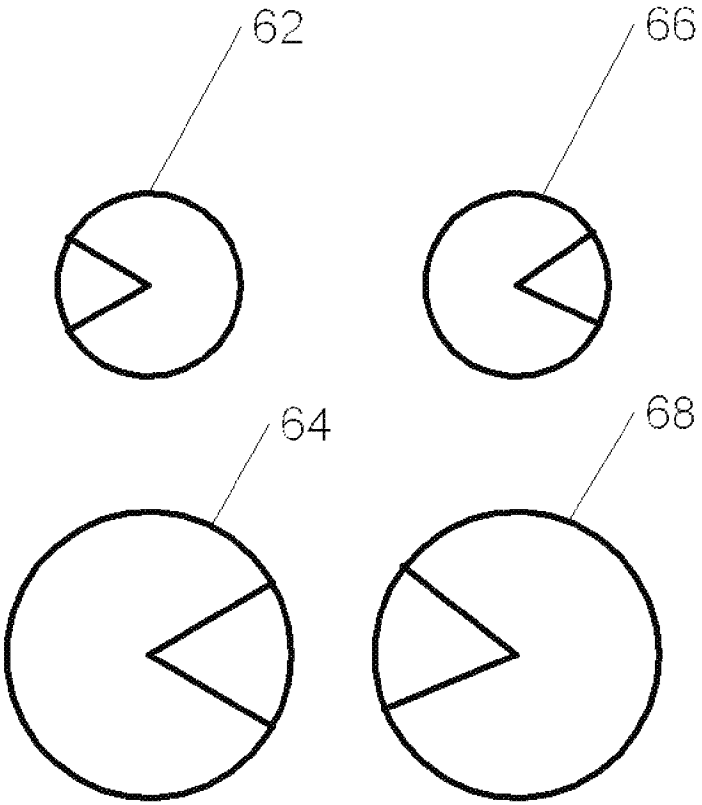
FIG. 7 is a diagrammatic view of four weights of the vertical force stabilization unit, illustrating the relative position of the weights at one moment of time other than the moments shown in FIGS. 6A-6E.

With the addition of the second set of weights on each vertical force stabilizer unit 46, the rotation of the weights will cancel all horizontal or lateral forces, leaving only the vertical forces to act externally, as is illustrated in FIG. 7. In order to properly cancel the horizontal forces and properly apply the required downward vertical force while minimizing the upward vertical force, the weight and speed ratios of the first pair of weights should be consistent with the weight and speed ratios of the second pair of weights.

Each of the vertical force stabilizer units 46 has a power source or motor 70 which is connected to and drives the shaft 60. The speed of the motor can be controlled to increase or decrease the speed of the rotating of the weights, which are connected through gears to the shaft 60. By controlling the speed and weight of the weights, the output force of the vertical force stabilizer unit 46 can be controlled and governed according to the amount of track settlement required.

Referring to FIGS. 5 and 6A through 6E, the movement and forces generated by the rotation of the weights of each vertical force stabilization unit will be more fully described. FIG. 5 is a graph illustrating the forces generated by the weights as the weights are rotated over time. In this embodiment, the vertical force stabilization unit has four weights, with two being the small weights 62, 66 and two being the large weights 64, 68.

The dotted line indicates the force generated by the small weights 62, 66. In the embodiment illustrated, the vertical force generated by the small weights ranges between approximately 11,000 pounds upward and 11,000 pounds downward, depending on the position of the small weights. As was previously discussed, the force generated can vary depending upon the size and eccentricity of the weights and the speed at which they are rotated. In the current example, each small weight has a weight of 5 pounds, a radius of 3 inches, and is rotated at 60 rps (revolutions per second). Therefore, each small weight generates a force of approximately 5,524 pounds.

The dashed line indicates the force generated by the large weights 64, 68. In the embodiment illustrated, the vertical force generated by the large weights ranges between approximately 11,000 pounds upward and approximately 11,000 pounds downward, depending on the position of the large weights. As was previously discussed, the force generated can vary depending upon the size and weight of the weights and the speed at which they are rotated. In the current example, each large weight has a weight of 10 pounds, a radius of 6 inches, and is rotated at 30 rps (revolutions per second). Therefore, each large weight generates a force of approximately 5,524 pounds.

The solid line indicates the summation of force generated by all of the weights described above. As is shown in FIG. 5, the combination of all of the vertical forces results in a force being applied to the track stabilization unit 30 of between approximately 12,000 pounds of upward force and approximately 22,000 pounds of downward force, depending on the position of the weights. As the total force in the upward direction is substantially less than the weight which can be applied by the machine or vehicle in the downward direction, the rotation of the weights of the vertical force stabilizer units 46 provides appropriate force to the rails 12 and the ballast, but does not cause the rollers 38 to be lifted from the rails 12 at any time during the rotation of the weights.

Figures 6A, 6B, 6C, 6D, 6E:
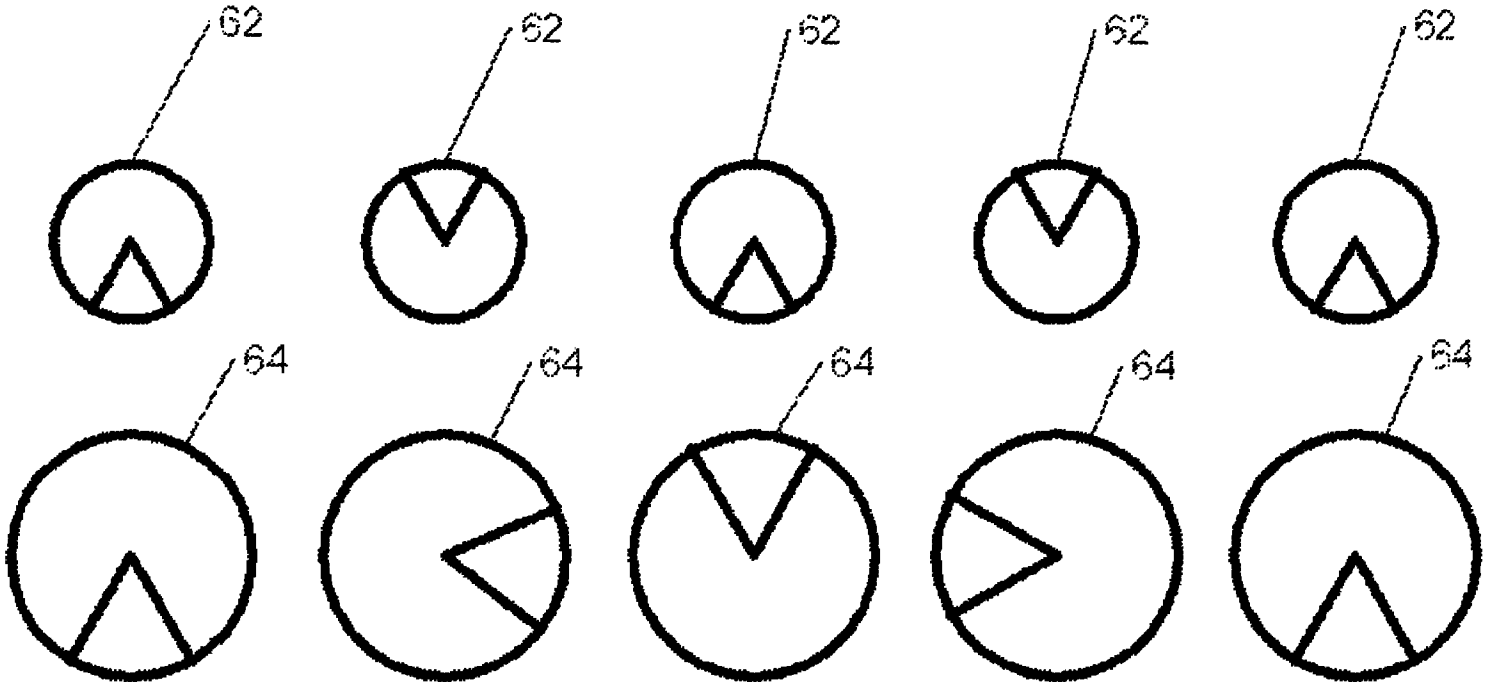
FIGS. 6A-6E are diagrammatic views of the positions of the weights of the vertical force stabilization unit as they are rotated, each figure corresponding to a location on the graph of FIG. 5 which is identified on the graph with a similar letter as the FIGS. 6A through 6E.

As the small weights and large weights are rotated at different speeds, the cumulative force in the downward direction can be greater than the cumulative force in the upward direction. As shown in FIG. 6A, which relates to position A in FIG. 5, the weights are both in the downward position; thereby, the cumulative forces associated therewith, when added together, result in the downward direction. In the example illustrated, as the small weights are rotated twice as fast as the large weights, the weights will be positioned as indicated in FIGS. 6A through 6E. In positions A and E in FIG. 5, which relate to FIGS. 6A and 6E, the weights are both in the downward position; thereby, the cumulative forces associated therewith, when added together, result in the downward direction. In positions B and D in FIG. 5, which relate to FIGS. 6B and 6D, the small weights are in the upward position and the large weight is in an intermediate position; thereby, the cumulative forces associated therewith, when added together, result in an upward direction. Because of the configuration of the weights and the relative rotation of each, this represents the maximum upward force which is applied to the vehicle. In positions C in FIG. 5, which relate to FIG. 6C, the small weights are in the downward position and the large weight is in the upward position; thereby, the cumulative forces associated therewith, when added together, result in zero force in the vertical direction.

As previously discussed, the vertical force stabilizer units 46 are configured to transmit forces only in the vertical direction. The configuration of the weights causes all lateral forces to be cancelled, resulting in no transmission of lateral forces. The first pair of weights 62, 66 and the second pair of weights of each vertical force stabilizer units 46 are rotated in opposite directions so that the lateral forces of one pair will cancel the lateral forces of the other pair, as is represented in FIG. 7.

In the track stabilization method described hereinabove, the ballast is vibrated to essentially fluidize the ballast, causing the ballast to move closely together to reach a very high density. The essentially horizontal vibrations extending transversely to the track are generated by the first vibrator device 42 and are imparted to the rails 12. The rails 12 and track are simultaneously subjected to essentially vertical load forces generated by the vertical force stabilization unit 46. The combination of the vertical forces and the horizontal forces causes the ballast to become so fluidized that the ballast attains a maximum density and a correspondingly reduced volume, causing the rails 12 and track supported thereon to sink to a desired level. The control means 34 monitors and controls the speed of the first vibrator device 42 and the vertical force stabilization unit 46 to control the amount of compaction of the ballast and, thereby, the level of the rails 12 and the track. The use of the vertical force stabilization unit 46 provides the vertical reaction capability without the need for the increased weight of the machine, thereby reducing the size and cost of the vehicle or machine while still providing the necessary vibration and downward force required to properly stabilize the ballast and the track. In addition, as the upward force associated with the vertical force stabilization unit 46 is minimized, the weight of a traditional vehicle is sufficient to maintain the vehicle 10 and the undercarriages 18, 20 in position on the rails 12 when the maximum upward force is applied (position C in FIG. 5). The weight of the vehicle also increases the maximum downward force. Therefore, the actual downward force applied to the rail in the exemplary embodiment is the sum of i) the forces represented at positions A and E in FIG. 5 and ii) the force applied by the weight of the vehicle 10.

While the vertical force stabilization unit 46 has been described with respect to the track stabilization unit 30, the use of the vertical force stabilization unit 46 is not so limited. The vertical force stabilization unit 46 can be used in any application in which a downward vertical force would be beneficial to the operation of the vehicle or unit attached thereto.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. An apparatus for applying a force to rails of a track, the apparatus comprising:

a device with at least one first weight and at least one second weight rotatably mounted about a horizontal shaft extending substantially centrally through the at least one first weight and the at least one second weight, the horizontal shaft having an axis which is essentially perpendicular to the longitudinal axis of the rails;

a power source provided to drive the rotation of the at least one first weight and the at least one second weight about the horizontal shaft at different revolutions per second;

the rotation of the at least one first weight and the at least one second weight creates a vertical force, the vertical force having a larger downward component as compared to an upward component of the vertical force.

2. The apparatus as recited in claim 1, wherein a weight of the at least one first weight is less than a weight of the at least one second weight.

3. The apparatus as recited in claim 2, wherein the weight of the at least one second weight is approximately twice the weight of the at least one first weight.

4. The apparatus as recited in claim 3, wherein the revolutions per second at which the at least one first weight is rotated is approximately double the revolutions per second at which the at least one second weight is rotated, thereby providing a downward vertical force with is double an upward vertical force.

5. The apparatus as recited in claim 2, wherein the revolutions per second at which the at least one first weight is rotated is greater than the revolutions per second at which the at least one second weight is rotated.

6. The apparatus as recited in claim 2, wherein the at least one first weight comprising two first weights and the at least one second weight comprising two second weights, the two first weights being rotated in opposite directions around the shaft at equal first revolutions per second and the two second weights being rotated in opposite directions around the shaft at equal second revolutions per second, whereby the opposed rotation of the two first weights and the opposed rotation of the two second weights causes the lateral forces generated by the respective first and second weights to cancel each other, leaving only the vertical forces to act externally of the first and second weights.

7. The apparatus as recited in claim 1, wherein a control mechanism is provided to control the revolutions per second at which the at least one first weight and the at least one second weight are rotated.

8. A vehicle for compacting ballast under rails of a track, the vehicle comprising:

a traction stabilization unit having a first vibrator unit, the first vibrator unit provided to generate forces which are transverse to a longitudinal axis of the rails;

at least one vertical force device with at least one first weight and at least one second weight rotatably mounted about a horizontal shaft extending substantially centrally through the at least one first weight and the at least one second weight, the horizontal shaft having an axis which is essentially perpendicular to the longitudinal axis of the rails, the rotation of the at least one first weight and the at least one second weight about the horizontal shaft creates a vertical force, the vertical force having a larger downward component as compared to an upward component of the vertical force;

a control mechanism provided to control transverse forces applied to the rails and to control vertical forces applied by the at least one vertical force device;

whereby the transverse forces generated by the traction stabilization unit and the vertical forces generated by the at least one vertical force device cause the ballast proximate the rails to be moved together to reach a high density.

9. The vehicle as recited in claim 8, wherein a power source drives the rotation of the first weight and the second weight at different revolutions per second.

10. The vehicle as recited in claim 9, wherein a weight of the at least one first weight is less than a weight of the at least one second weight.

11. The vehicle as recited in claim 10, wherein the weight of the at least one second weight is approximately twice the weight of the at least one first weight.

12. The vehicle as recited in claim 11, wherein the revolutions per second at which the at least one first weight is rotated is greater than the revolutions per second at which the at least one second weight is rotated.

13. The vehicle as recited in claim 12, wherein the revolutions per second at which the at least one first weight is rotated is approximately double the revolutions per second at which the at least one second weight is rotated, thereby providing a downward vertical force with is double an upward vertical force.

14. The vehicle as recited in claim 13, wherein the at least one first weight comprising two first weights and the at least one second weight comprising two second weights, the two first weights are rotated in opposite directions around the shaft at equal revolutions per second and the two second weights are rotated in opposite directions around the shaft at equal revolutions per second, whereby the opposed rotation of the two first weights and the opposed rotation of the two second weights will cause the lateral forces generated by the respective weights to cancel each other, leaving only the vertical forces to act externally of the weights.

15. The vehicle as recited in claim 8, wherein the track stabilization unit has rollers which engage and cooperate with each respective rail of the track, the at least one vertical force device comprising two vertical force devices, each of the two vertical forces devices being positioned over each respective rail proximate the rollers of the track stabilization unit.

16. A method of supplying downward force to rails of a track, the method comprising:

positioning a device on a rail vehicle, the device having at least one first weight and at least one second weight rotatably mounted about a horizontal shaft extending substantially centrally through the at least one first weight and the at least one second weight;

positioning the rail vehicle over a work area; and creating a vertical force by rotating the at least one first weight and the at least one second weight about the shaft at different revolutions per second.

17. The method as recited in claim 16, further comprising rotating the at least one first weight at a first revolutions per second, and rotating the at least one second weight at a second revolutions per second, wherein the first revolutions per second is greater than the second revolutions per second.

18. The method as recited in claim 17, wherein the revolutions per second at which the at least one first weight is rotated is approximately double the revolutions per second at which the at least one second weight is rotated, thereby providing a downward vertical force with is double an upward vertical force.

19. The method as recited in claim 16, wherein a weight of the at least one first weight is less than a weight of the at least one second weight.

20. The method as recited in claim 19, wherein the weight of the at least one second weight is approximately twice the weight of the at least one first weight.

21. The method as recited in claim 16, wherein the at least one first weight comprising two first weights and the at least one second weight comprising two second weights.

22. The method as recited in claim 21, further comprising: rotating the two first weights in opposite directions at equal revolutions per second; rotating the two second weights in opposite directions around the shaft at equal revolutions per second: whereby the opposed rotation of the two first weights and the opposed rotation of the two second weights will cause the lateral forces generated by the respective weights to cancel each other, leaving only the vertical forces to act externally of the weights.

23. The method as recited in claim 16, further comprising: powering and controlling the rotation of the at least one first weight and the rotation of the at least one second weight to allow the speed of the rotations to be altered as required.

24. An apparatus for applying a force to rails of a track, the apparatus comprising:

a device with at least two first weights and at least two second weights rotatably mounted about a horizontal shaft extending substantially centrally through the at least one first weight and the at least one second weight, the horizontal shaft having an axis which is essentially perpendicular to the longitudinal axis of the rails;

a power source provided to drive the rotation of the at least two first weights and the at least two second weights about the horizontal shaft at different revolutions per second, the two first weights are rotated in opposite directions around the shaft at equal first revolutions per second and the two second weights are rotated in opposite directions around the shaft at equal second revolutions per second;

the rotation of the at least two first weights and the at least two second weights creates a vertical force, the vertical force having a larger downward component as compared to an upward component of the vertical force, and whereby the opposed rotation of the at least two first weights and the opposed rotation of the at least two second weights causes the lateral forces generated by the respective at least two first weights and the at least two second weights to cancel each other, leaving only the vertical forces to act externally of the at least two first weights and the at least two second weights.

* * * * *